US005261338A

United States Patent [19]

Tajima et al.

[11] Patent Number: 5,261,338

[45] Date of Patent: Nov. 16, 1993

[54] EMBROIDERY MACHINE

[75] Inventors: Ikuo Tajima; Tomoaki Anezaki; Masayoshi Hirate, all of Kasugai, Japan

[73] Assignee: Tokai Kogyo Mishin Kabushiki Kaisha, Kasugai, Japan

[21] Appl. No.: 991,252

[22] Filed: Dec. 16, 1992

[30] Foreign Application Priority Data

Dec. 17, 1991 [JP] Japan ..... 3-110705[U]

[51] Int. Cl.[5] ..... D05C 9/04

[52] U.S. Cl. ..... 112/103; 112/121.15; 112/309

[58] Field of Search ..... 292/173, 219, 228, 121, 292/128, DIG. 11, 102; 112/103, 121.12, 121.15, 63, 309, 318, 322; 285/320; 403/321, 322, 324, 325, 326, 330

[56] References Cited

U.S. PATENT DOCUMENTS 409,512 8/1989 Smith ..... 285/320 X
969,307 9/1910 Sumerlin ..... 403/330 X
1,667,771 5/1928 Chiapparelli ..... 292/228 X
2,144,834 1/1939 Cesare ..... 285/320
4,628,843 12/1986 Tajima ..... 112/121.12
5,167,194 12/1992 Nakagaki ..... 112/103

*Primary Examiner*—Clifford D. Crowder
*Assistant Examiner*—Paul C. Lewis
*Attorney, Agent, or Firm*—Dennison, Meserole, Pollack & Scheiner

[57] ABSTRACT

An embroidery machine includes a sewing head, a rotary ring rotatable around an axis and movable relative to the sewing head, and a work support frame for supporting a work to be embroidered. A lever is pivotaly supported by the rotary ring. An engaging member is mounted on one end of the lever for engagement with an engaging hole formed on the work support frame so as to fix the work support frame in position relative to the rotary ring. A biasing member biases the lever in a direction in which the engaging member engages with the engaging hole.

8 Claims, 6 Drawing Sheets

EMBROIDERY MACHINE

BACKGROUND OF THE INVENTION

1. Field of the Invention

The present invention relates to an embroidery machine which includes a device for mounting a work support frame on a rotary ring.

2. Description of the Prior Art

A conventional embroidery machine for embroidering figures on a curved work such as a cap includes a rotary ring disposed under a sewing head. The rotary ring is movable relative to the sewing head and is rotatably driven by a drive device. A support frame for mounting the work thereon is detachably mounted on the rotary ring through a mounting device.

A prior art mounting device of a roller-holder type is shown in FIG. 7. As shown in FIG. 7, a work support frame 21 on which a cap C is mounted includes a mounting portion 21*a* having substantially C-shaped configuration. A rotary ring 22 includes a cylindrical support portion 22*a* for fitting thereon the mounting portion 21*a* of the work support frame 21. A plurality of rollers 22*b* are mounted on the rotary ring 22 through leaf springs 22*c*, respectively, and are biased toward the cylindrical portion 22*a*. The mounting portion 21*a* of the work support frame 21 includes a plurality of recesses 21*b* at positions corresponding to the rollers 22*b* for engagement therewith.

In a mounting operation of the work support frame 21, the work support frame 21 is moved toward the rotary ring 22 in an axial direction in such a manner that the mounting portion 21*a* is inserted between the rollers 22*b* and the cylindrical support portion 22*a*. Then, the rollers 22*b* are engaged with their corresponding recesses 21*b* of the mounting portion 21*a* through the biasing force of the leaf springs 22*c*, and the work support frame 21 is fixed in place relative to the rotary ring 22.

In the conventional mounting device, however, the fixing force of the work support frame 21 is derived from the force of the leaf springs 22*c*. Therefore, the leaf springs 22*c* must have strong resilient forces for supporting the work support frame 21 without rattling when the rotary ring 22 is rotated. This may cause difficulties in mounting and removing the work support frame 21 since the rollers 22*b* must be lifted against the biasing force of the leaf springs 22*c*.

SUMMARY OF THE INVENTION

It is, accordingly, an object of the present invention to provide a device for mounting a work support frame on a rotary ring in an embroidery machine which permits the work support frame to be easily mounted on and removed from the rotary ring.

According to the present invention, there is provided an embroidery machine comprising:

a sewing head;

a rotary ring rotatable around an axis and movable relative to the sewing head;

a work support frame for supporting a work to be embroidered;

a lever pivotally supported by the rotary ring;

an engaging member mounted on one end of the lever for engagement with an engaging hole formed on the work support frame so as to fix the work support frame in position relative to the rotary ring; and a biasing member for biasing the lever in a direction in which the engaging member engages with the engaging hole.

The invention will become more fully apparent from the claims and the description as it proceeds in connection with the drawings.

BRIEF DESCRIPTION OF THE DRAWINGS

FIG. 3(*b*) is a side view of the work support frame;

FIG. 4(*b*) is a plan view of FIG. 3(*b*);

FIG. 6(*b*) is a sectional view similar to FIG. 6(*a*), but showing a different operation.

DETAILED DESCRIPTION OF THE PREFERRED EMBODIMENT

An embodiment of the present invention will now be explained with reference to FIGS. 1 to 6.

Figure 1:
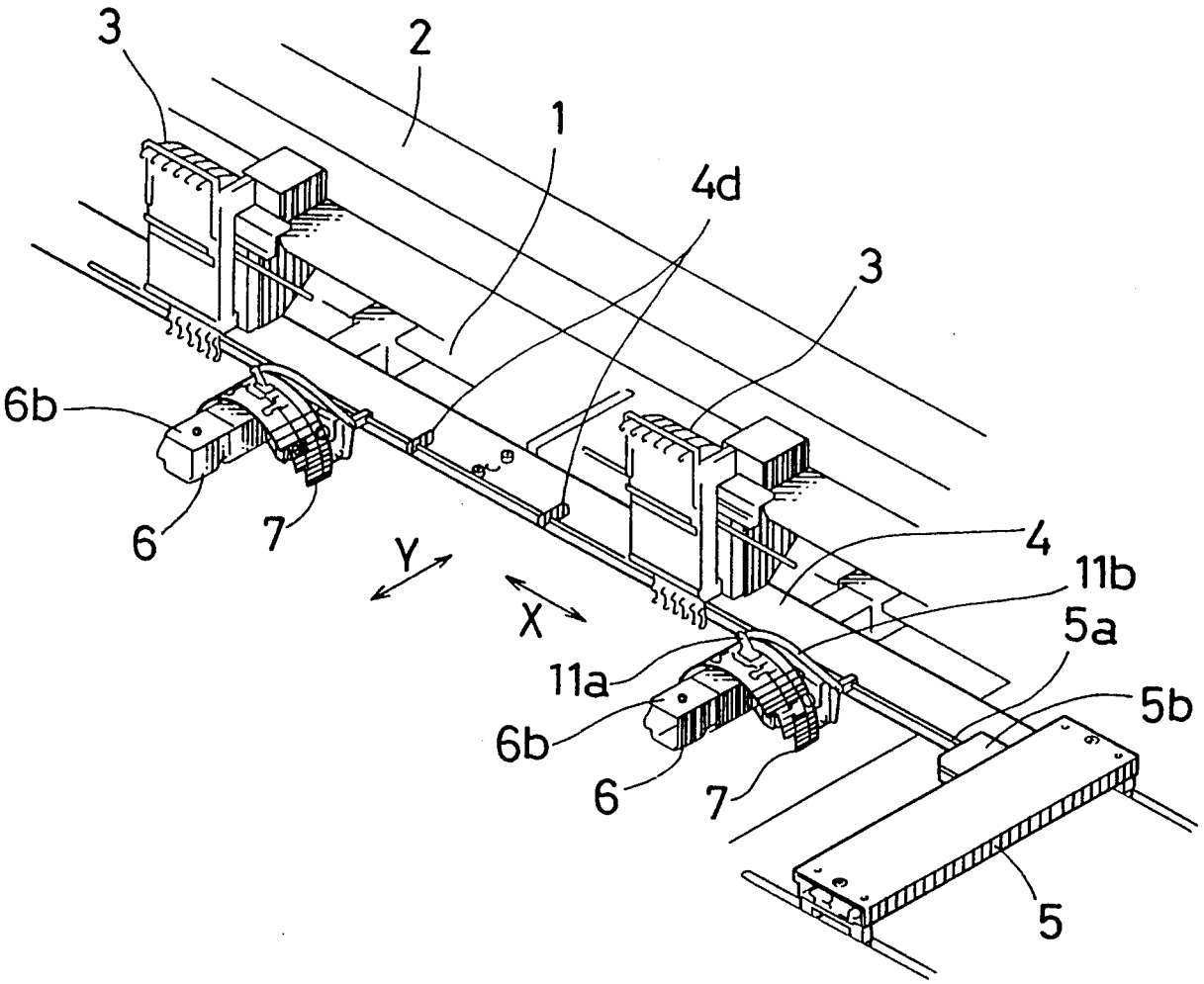
FIG. 1 is a perspective of a main part of an embroidery machine including a work support frame mounting device according to an embodiment of the present invention.

Referring to FIG. 1, there is shown, in perspective view, a main part of an embroidery machine having a plurality of sewing heads 3. The embroidery machine includes a machine table 1 and a linear machine frame 2 disposed above the machine table 1 and extending in a longitudinal direction of the machine table 1. The sewing heads 3 are mounted on the machine frame 2 and are spaced from each other at a predetermined distance. A Y-direction movable member 4 and an X-direction movable member 5 are disposed on the machine table 1 and are moved in Y-direction and X-direction in FIG. 1, respectively. Each of the Y-direction movable member 4 and the X-direction movable member 5 is driven by a suitable drive mechanism such as a belt-type drive mechanism (not shown). A plurality of rotary rings 7 are mounted on the Y-direction movable member 4 at positions corresponding to the sewing heads 3. Each of the rotary rings 7 is rotatable around an axis of Y-direction. A support arm 6 extends from the machine table 1 through each of the rotary rings 7 in Y-direction. The support arm 6 includes a shuttle 6*a* and a throat plate 6*b* as shown in FIG. 2.

The construction of the Y-direction movable member 4 and the rotary rings 7 will now be explained with reference to FIGS. 2, 3(*a*) and 3(*b*). The Y-direction movable member 4 includes a flat plate-like base plate 4*a* having substantially rectangular configuration and a plurality of reinforcing ribs 4*b* (five in this embodiment) disposed along the longitudinal direction of the base plate 4*a*. The base plate 4*a* includes a plurality of mounting holes 4*c* for mounting flange members 8 of the rotary rings 7 as will be hereinafter explained. The base plate 4*a* further includes a plurality of guide members 4*d* having substantially L-shaped configuration and are spaced from each other in the longitudinal direction. A rod 5*a* is slidably inserted through the guide members 4*d* in the X direction and has one end connected to a block member 5b which is slidably movable in Y-direction relative to the X-direction movable member 5 (see FIG. 1).

Each of the rotary rings 7 includes the flange member 8 secured to the Y-direction movable member 4 and a ring body 9 rotatably supported by the flange member 8. The flange member 8 is made of relatively thin plate-like material and includes a horizontal upper portion 8a. The upper portion 8a includes pins 8b on which bolts 4e are screwed through the mounting holes 4c of the Y-direction movable member 4, respectively. The flange member 8 further includes a vertical side portion 8c on which a support member 10 is mounted for supporting the ring body 9. A triangular rib 8d is connected between the upper portion 8a and the side portion 8c. Two pairs of rollers 8e are rotatably supported by pins 8f which are fixed to the side portion 8c. Each pair of rollers 8e are opposed to each other in a radial direction of the rotary ring 7 and are spaced from each other at a predetermined distance.

Figure 2:
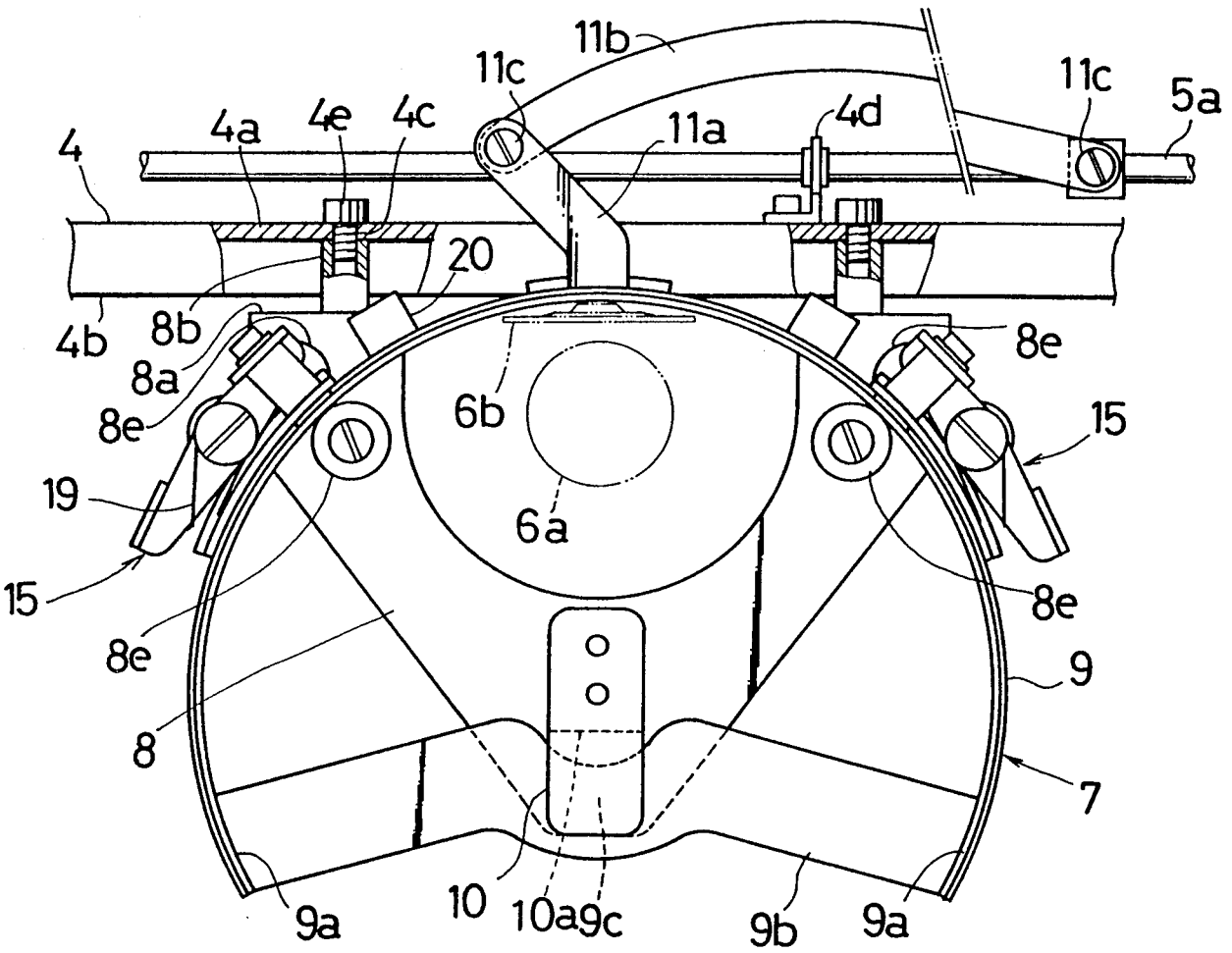
FIG. 2 is an enlarged front view of a rotary ring shown in FIG. 1.
Figure 3B:
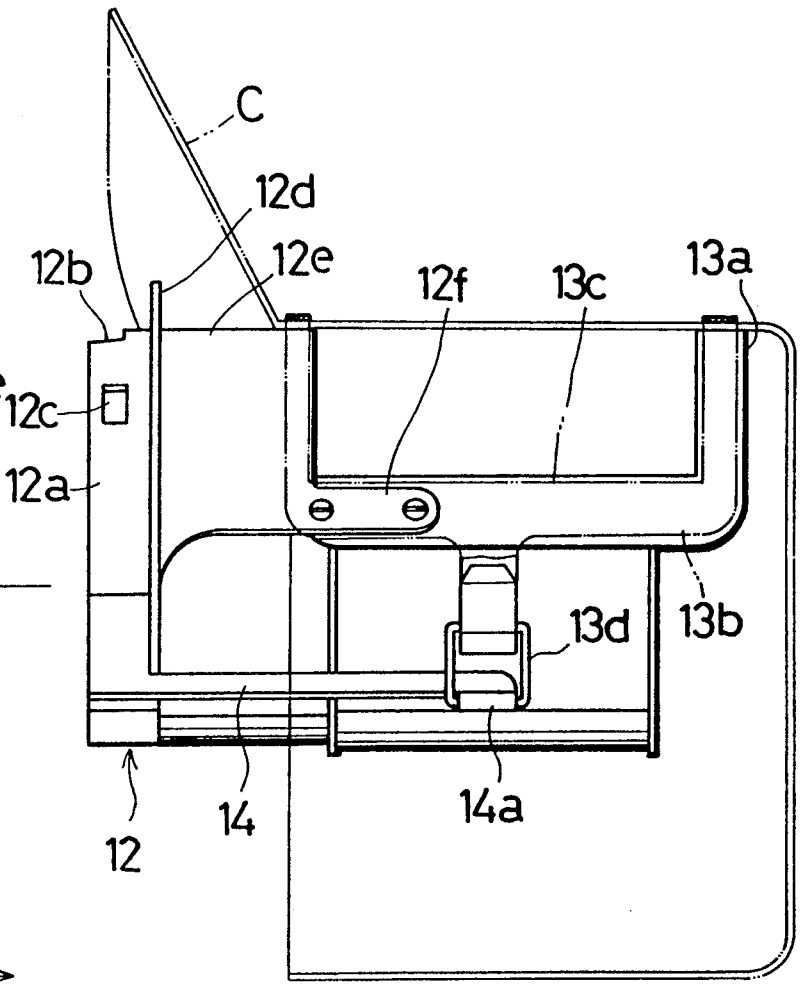
FIG. 3(*a*) is a side view of the rotary ring.
Figure 3A:
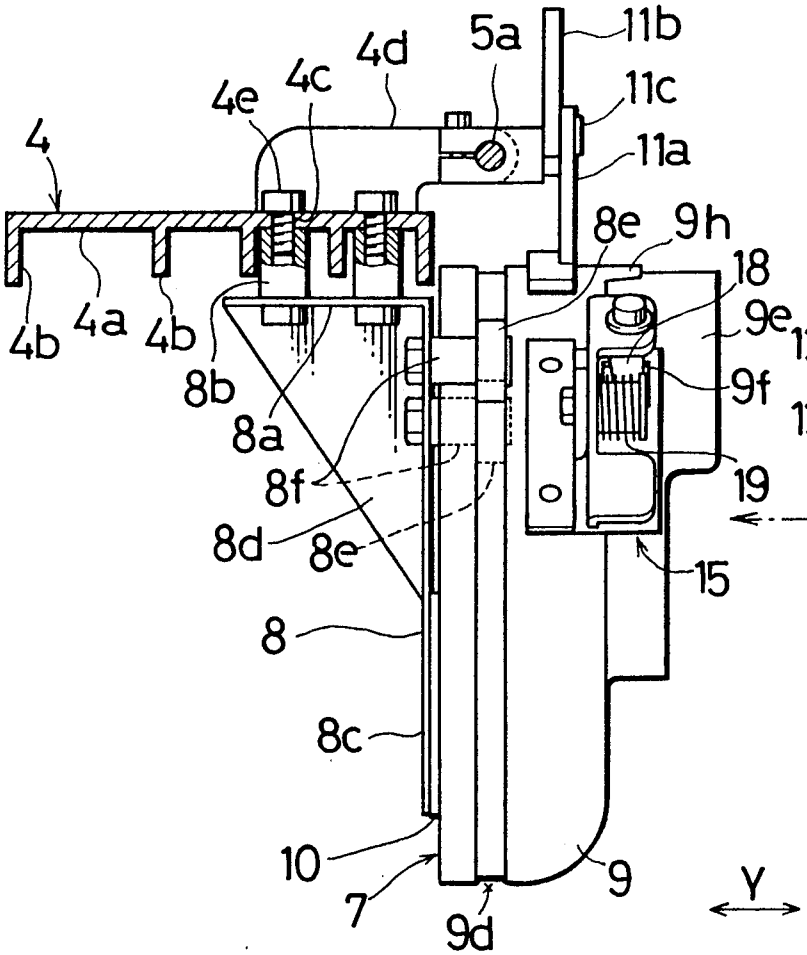

As shown in FIG. 2, the ring body 9 has substantially C-shaped configuration and includes end portions 9a in a circumferential direction. An elongated plate 9b is connected between the end portions 9a and extends in substantially diametrical direction of the ring body 9. The plate 9b includes arcuate bent portion 9c at the central portion. The support member 10 has substantially rectangular configuration and includes a recess 10a at the lower portion for slidably receiving the bent portion 9c of the plate 9. As shown in FIG. 3(*a*), the ring body 9 includes a circumferential recess 9d having substantially U-shaped configuration in section. The ring body 9 further includes a support portion 9e for mounting thereon a work support frame 12 which supports a cap C to be embroidered as will be hereinafter explained. The support portion 9e has substantially C-shaped configuration of relatively smaller radius than that of the ring body 9.

The circumferential recess 9d of the ring body 9 partly receives one of the pair of the rollers 8e positioned outwardly. The other of the pair of the rollers 8e contacts the inner surface of the ring body 9. Thus, the ring body 9 is rotatably supported by the flange member 8 through two pairs of the rollers 8e and is prevented from movement in an axial direction by the support member 10.

A drive lever 11a is fixed to the upper central portion of the ring body 9 and extends upwardly therefrom. A link member 11b has both ends pivotaly connected to the upper end of the drive lever 11a and the rod 5a through pins 11c, respectively. The ring body 9 further includes a pair of mounting devices 15 as will be hereinafter explained.

As described above, since the rotary ring 7 is mounted on the Y-direction movable member 4, it is movable together with the Y-direction movable member 4 in Y-direction. On the other hand, as the X-direction movasble member 5 is moved, the ring body 9 is rotated through the rod 5a and the link member 11b.

Figures 4A, 4B:
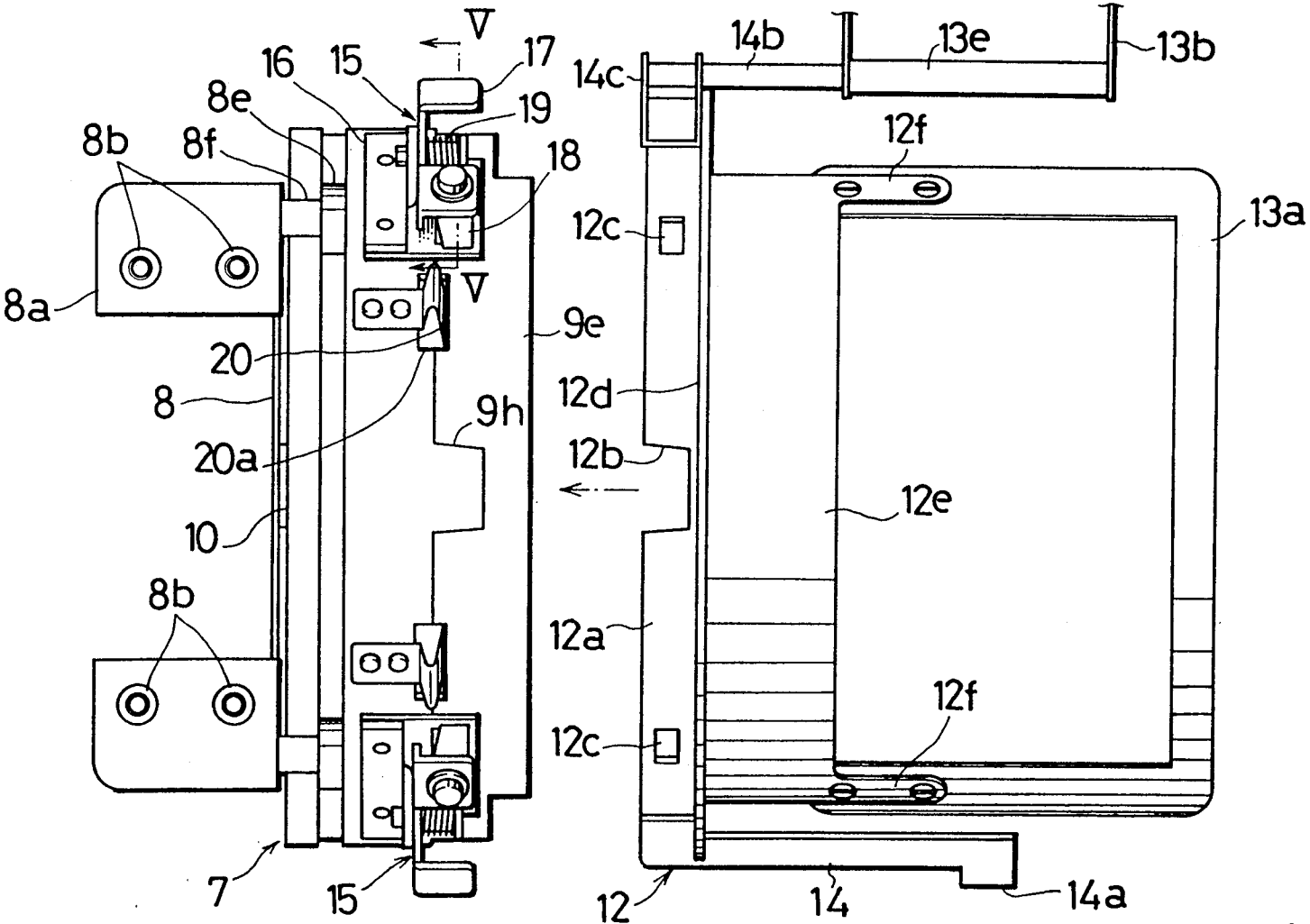
FIG. 4(*a*) is a plan view of FIG. 3(*a*)

The construction of the work support frame 12 for supporting the cap C to be embroidered will now be explained. The work support frame 12 includes a mounting portion 12a having substantially C-shaped configuration corresponding to the support portion 9e of the rotary ring 7, a frame portion 13a extending in the same curved plane as the mounting portion 12a but having substantially U-shaped configuration in plan view as shown in FIG. 4(*b*), and a presser portion 13b for pressing the cap C on the frame portion 13a. The mounting portion 12a includes a recess 12b formed at the central position and a pair of rectangular slots 12c formed on both sides of the recess 12b in a circumferential direction. The slots 12c are displaced from the recess 12b at an angle of 30° in the circumferential direction, respectively. A base portion 12e extends from the mounting portion 12a in an axial direction of the mounting portion 12a and has a configuration corresponding to a part of a cylinder. A collar 12d is formed between the mounting portion 12a and the base portion 12e to extend outwardly therefrom. The base portion 12e includes protrusions 12f disposed at both ends in a circumferential direction for screwing the frame portion 13a thereon. A rod-like support portion 14 is mounted on one end of the mounting portion 12a in the circumferential direction and extends in the axial direction. A claw 14a is formed on the end portion of the support portion 14 for fixing the presser portion 13b in position. A support rod 14b is mounted on the other end of the mounting portion 12a through a mounting plate 14c.

The presser portion 13b includes a flexible rectangular frame-like part 13c and a hook part 13d mounted on one end of the frame-like part 13c. The hook part 13d serves to engage with the claw 14a. A sleeve 13e is mounted on the other end of the frame-like part 13c and is rotatably fitted on the support rod 14b.

To fix the cap C on the work support frame 12, the presser portion 13b is pivoted around the support rod 14b to be moved away from the frame portion 13a. The cap C is then fitted on the frame portion 13a with its visor positioned upwardly. The presser portion 13b is thereafter pivoted to be positioned on the cap C. The cap C is clamped between the presser portion 13b and the frame portion 13a when the hook part 13d is engaged with the claw 14a as shown in FIG. 3.

A mechanism for mounting the work support frame 12 on the rotary ring 7 will now be explained. As shown in FIG. 4(*a*), the support portion 9e of the rotary ring 7 includes a protrusion 9h which is disposed at the central position of the support portion 9e and extends in the axial direction for engagement with the recess 12b of the mounting portion 12a of the work support frame 12 so as to prevent the work support frame 12 from rotation relative to the rotary ring 7. A pair of V-shaped leaf springs 20 are mounted on the outer surface of the ring body 9 and are resiliently deformable in the axial direction. A hole 20a is formed at a position adjacent each of the leaf springs 20 so as to receive the end portion of the corresponding leaf spring 20. The leaf springs 20 abut on the collar 12d of the work support frame 12 so as to bias the support frame 12 in the axial direction away from the rotary ring 7 when the work support frame 12 is mounted on the rotary ring 7.

The support portion 9e further includes a pair of rectangular slots 9f which are disposed at positions corresponding to the pair of rectangular slots 12c formed on the mounting portion 12a of the work support frame 12, respectively. The mounting devices 15 are mounted on the support portion 9e and include a wedge member 18 for inserting into the corresponding rectangular slots 9f, respectively.

The construction of each of the mounting devices 15 will now be explained with reference to FIGS. 5, 6(*a*) and 6(*b*). The mounting device 15 includes a support member 16 and a lever 17 pivotaly movable relative to the support member 16. The wedge member 18 is secured to the lever 17. A spring 19 biases the lever 17 in one direction as will be explained later. The support member 16 is secured to the ring body 9 through a countersunk screw 15*a* and includes a rectangular mounting plate 16*a* and an L-shaped support plate 16*b* mounted on the mounting plate 16*a*. A part of the mounting plate 16*a* extends to form a gap 15*b* between the support portion 9*e* for inserting the mounting portion 12*a*. The mounting plate 16*a* includes a rectangular slot 15*c* at a position corresponding to the rectangular slot 9*f*. A support shaft 16*c* is mounted on the support plate 16*b* for pivotaly supporting the lever 17. The support shaft 16*c* extends in parallel with the axis of the rotary ring 7.

The lever 17 is of L-shaped configuration in section and is of boat-shaped configuration in side view. The wedge member 18 is mounted on one end of the lever 17 by a bolt 17*a*. The support shaft 16*c* is slidably inserted into the central portion of the lever 17. A seat 17*b* is mounted on the other end of the lever 17 for pressing operation by fingers of an operator.

Figure 5:
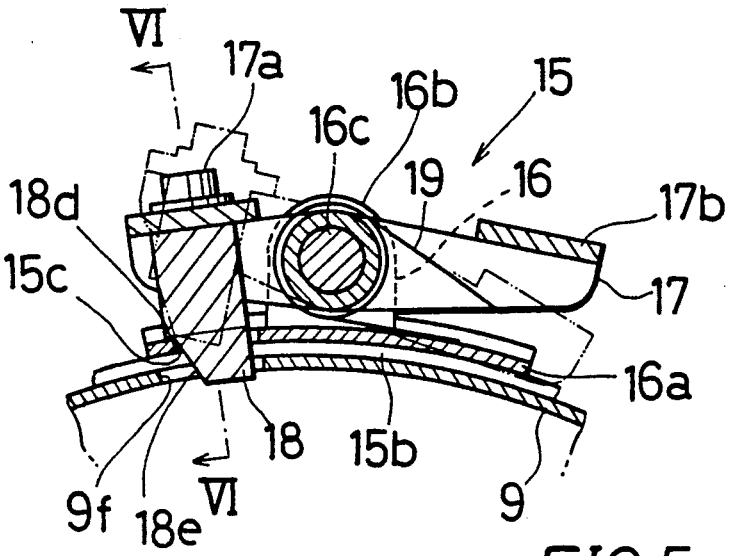
FIG. 5 is an enlarged sectional view taken along line V—V in FIG. 4(*a*)

As shown in FIG. 5, the wedge member 18 includes a stepped portion 18*d* and a slant surface 18*e* extending downwardly from the stepped portion 18*d* in such a manner that the wedge member 18 has a thickness which becomes smaller in a downward direction. The stepped portion 18*d* and the slant surface 18*e* are disposed on one side in the circumferential direction of the support portion 9*e*. A wedge surface 18*a* is formed on one side (on a side of the work support frame 12) in the axial direction of the support portion 9*e*. A threaded hole 18*b* is formed on the upper portion of the wedge member 18 for engagement with the bolt 17*a*.

The spring 19 for biasing the lever 17 is a spiral spring fitted on the support shaft 16*c* and biases the lever 17 in such a direction that the wedge member 18 is moved toward the rectangular slot 9*f*. The wedge member 18 is moved away from the rectangular slot 9*f* when the operator presses the seat 17*b* to pivot the lever 17 against the biasing force of the spring 19.

The operation of the mounting device 15 will now be explained.

When the work support frame 12 is not mounted on the rotary ring 7, the wedge member 18 is inserted into the rectangular slots 15*c* and 9*f* and the stepped portion 18*d* abuts on the upper surface or a stopper portion of the periphery of the rectangular recess 15*c* by the biasing force of the spring 19 to maintain the wedge member 18 in an inserted position against further movement by the biasing force. At this stage, the wedge surface 18*a* is positioned to intersect the recess 15*b*.

Figure 6A:
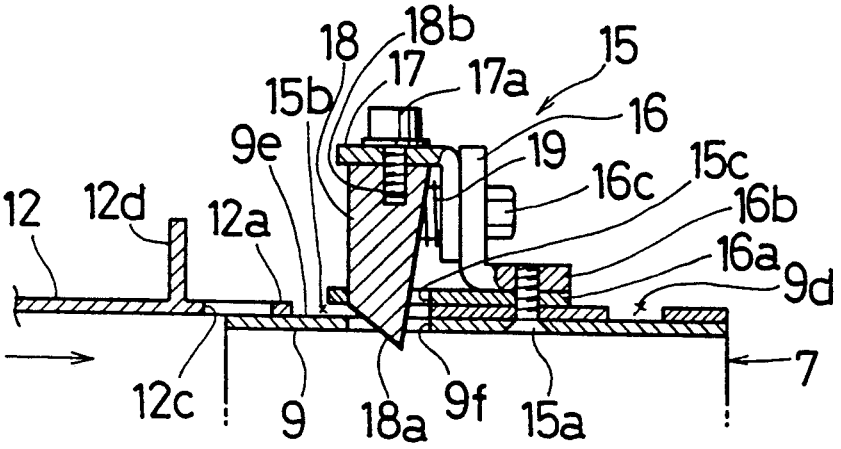
FIG. 6(*a*) is a sectional view taken along line VI—VI in FIG. 5.
Figure 6B:
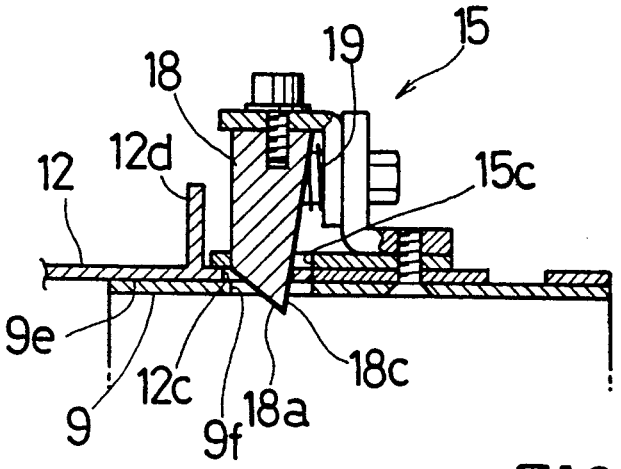
Figure 7:
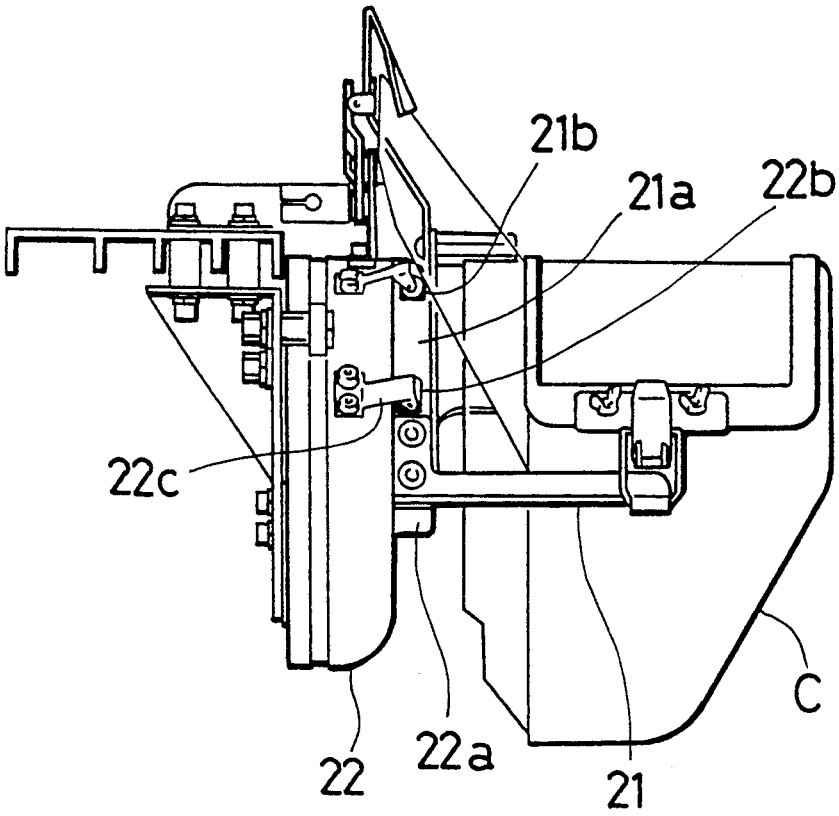
FIG. 7 PRIOR ART
FIG. 7 is a side view of a main part of a prior art embroidery machine.

When the work support frame 12 is moved toward the rotary ring 7 in the axial direction in such a manner that the mounting portion 12*a* is moved along the support portion 9*e* as shown by an arrow in FIG. 6(*a*), the end portion of the mounting portion 12*a* is inserted into the recess 15*b* and abuts on the wedge surface 18*a* of the wedge member 18. As the work support frame is further moved axially, the wedge member 18 is lifted through cooperation of the end portion of the fitting portion 12*a* and the wedge surface 18*a* to permit movement of the end portion beyond the wedge member 18. When the end portion reaches a position where the rectangular slot 12*c* of the mounting portion 12*a* is in alignment with the rectangular slot 9*f* of the support portion 9*e*, the wedge member 18 recovers its initial position by the biasing force of the spring 19 while it is also inserted into the rectangular slot 12*c* as shown in FIG. 6(*b*). The wedge member 18 is retained in this position against further movement by the biasing force by engagement of the stepped portion 18*d* with the stopper portion of the rotary ring. Meanwhile, the end portion abuts on the leaf springs 20 and is moved against the biasing force of the leaf springs 20 before the wedge member 18 is inserted into the rectangular slot 12*c*.

At the mounting state as shown in FIG. 6(*b*), a rear surface 18*c* of the wedge member 18 contacts a part of the peripheral surface of the rectangular slot 12*c* facing thereto in substantially parallel relationship with each other, and therefore the work support frame 12 is reliably prevented from removing from the rotary ring 7 in the axial direction or Y-direction. The movement of the work support frame 12 in the circumferential direction relative to the rotary ring 7 is prevented through abutment of the wedge member 18 on the other part of the peripheral surface of the rectangular slot 12*c* facing thereto.

To remove the work support frame 12 from the rotary ring 7, the operator presses the seat 17*b* to pivot the lever 17 against the biasing force of the spring 19. The wedge member 18 is thus lifted and is disengaged from the rectangular slot 12*c* of the work support frame 12. Therefore, the function required to the spring 19 is only to keep the wedge member 18 in engagement with the rectangular slots 12*c* and 9*f*, so that the spring 19 may have a smaller biasing force. This may permit the lever 17 to be pivoted by the operator with a smaller force. As the wedge member 18 is thus disengaged, the work support frame 12 is forced to be moved away from the rotary ring 7 by the biasing force of the leaf springs 20.

While the invention has been described with reference to a preferred embodiment, it is to be understood that modifications or variation may be easily made without departing from the spirit of this invention which is defined by the appended claims.

What is claimed is:

1. An embroidery machine comprising:

a sewing head;

a rotary ring, and means for supporting said rotary ring for rotation around an axis and for movement relative to said sewing head;

a work support frame for supporting a work to be embroidered and adapted for axial movement relative to said rotary ring, and an engaging hole formed on said work support frame;

a lever, means supporting said lever on said rotary ring and defining a pivotal axis for pivotal movement of said lever thereabout;

an engaging member mounted on one end of said lever for engagement with said engaging hole formed on said work support frame so as to fix said work support frame in position relative to said rotary ring;

said lever being pivotally movable between a first position for engagement of said engaging member with said engaging hole and a second position for disengagement of said engaging member from said engaging hole;

biasing means disposed between said lever and said rotary ring for biasing said lever in a direction toward said first position;

said lever being movable from said first position to said second position against the biasing force of said biasing means when said work support frame is moved toward said rotary ring in an axial direction relative to said rotary ring, so that one end of said work support frame located axially of said rotary ring is movable toward said rotary ring beyond said engaging member to position said engaging hole to engage with said engaging member;

said rotary ring including a first hole for permitting insertion of an end portion of said engaging member, said rotary ring further including a stopper portion for keeping said engaging member at a position in engagement with said engaging hole of said work support frame against the biasing force of said biasing means.

2. The embroidery machine as defined in claim 1 wherein said rotary ring includes a ring body having said first hole and a plate member mounted on said ring body; a recess is formed between said ring body and said plate member for receiving said one end of said work support frame; and said plate member includes a second hole disposed in alignment with said first hole for permitting insertion of said end portion of said engaging member.

3. The embroidery machine as defined in claim 1 wherein said stopper portion is formed on the periphery of said second hole of said plate member.

4. The embroidery machine as defined in claim 3 wherein said engaging member includes a stepped portion on a side positioned away from said pivotal axis of said lever for abutment on said stopper portion.

5. The embroidery machine as defined in claim 1 wherein said lever includes an operable portion for operation by an operator to pivot said lever against the biasing force of said biasing means so as to disengage said engaging member from said engaging hole.

6. The embroidery machine as defined in claim 1 wherein said engaging member includes a slant surface formed for cooperation with said one end of said work support frame in such a manner that said lever is pivoted against the biasing force of said biasing means through abutment of said one end of said work support frame on said slant surface of said engaging member to form a gap between said engaging member and said rotary ring so as to permit passage of said one end of said work support frame therethrough, and that said engaging member is moved toward said engaging hole by the biasing force of said biasing means when said engaging hole is positioned in alignment with said engaging member.

7. An embroidery machine comprising;

a sewing head;

a rotary ring, and means for supporting said rotary ring for rotation around an axis and for movement relative to said sewing head;

a work support frame for supporting a work to be embroidered and adapted for axial movement relative to said rotary ring, and an engaging hole formed on said work support frame;

a lever, means supporting said lever on said rotary ring and defining a pivotal axis for pivotal movement of said lever thereabout;

an engaging member mounted on one end of said lever for engagement with said engaging hole formed on said work support frame so as to fix said work support frame in position relative to said rotary ring;

said lever being pivotally movable between a first position for engagement of said engaging member with said engaging hole and a second position for disengagement of said engaging member from said engaging hole;

biasing means disposed between said lever and said rotary ring for biasing said lever in a direction toward said first position;

said pivotal axis of said lever extending substantially in parallel with the rotational axis of said rotary ring.

8. The embroidery machine as defined in claim 7 wherein said rotary ring includes second biasing means for biasing said work support frame in the axial direction away from said rotary ring when said engaging member is in engagement with said engaging hole.

* * * * *